United States Patent [19]

Kitagawa

[11] Patent Number: 4,485,717

[45] Date of Patent: Dec. 4, 1984

[54] ELECTRONIC MUSICAL INSTRUMENT

[75] Inventor: Hiroshi Kitagawa, Iwata, Japan

[73] Assignee: Kabushiki Kaisha Kawai Gakki Sesisakusho, Hamamatsu, Japan

[21] Appl. No.: 543,316

[22] Filed: Oct. 19, 1983

Related U.S. Application Data

[63] Continuation of Ser. No. 315,983, Oct. 28, 1981, abandoned.

[30] Foreign Application Priority Data

Oct. 28, 1980 [JP] Japan ..... 55-151124

[51] Int. Cl.[3] ..... G10H 1/043

[52] U.S. Cl. ..... 84/1.22; 84/1.23; 84/1.24

[58] Field of Search ..... 84/1.19–1.24, 84/1.01

[56] References Cited

U.S. PATENT DOCUMENTS

| | | | |
|---|---|---|---|
| 3,913,442 | 10/1975 | Deutsch | 84/1.19 |
| 4,084,472 | 4/1978 | Niimi | 84/1.19 X |
| 4,114,498 | 9/1978 | Chibana et al. | 84/1.19 |
| 4,135,427 | 1/1979 | Deutsch | 84/1.22 |
| 4,178,825 | 12/1979 | Deutsch | 84/1.24 |
| 4,205,577 | 6/1980 | Deutsch | 84/1.21 |
| 4,282,790 | 8/1981 | Wachi | 84/1.21 |
| 4,387,622 | 6/1983 | Deutsch | 84/1.22 |

*Primary Examiner*—Stanley J. Witkowski

[57] ABSTRACT

An electronic musical instrument which produces a musical sound by controlling harmonics coefficient and using computing means based on the discrete Fourier transfer. For a fundamental wave, a period function indicated by predetermined period data is generated and, for a harmonic wave, a period function of a period having a predetermined relation to the period of the fundamental wave is generated. By the period function thus obtained, a modulating waveshape memory is read out to obtain modulating data, which is multiplied by a harmonic coefficient.

3 Claims, 6 Drawing Figures

ELECTRONIC MUSICAL INSTRUMENT

CROSS REFERENCE TO RELATED APPLICATION

This is a continuation of application Ser. No. 315,983 filed Oct. 28, 1981, and now abandoned.

This is related to U.S. Pat. No. 4,085,644.

BACKGROUND OF THE INVENTION

1. Field of the Invention

The present invention relates to an electronic musical instrument which allows for the reduction of required memory capacity by one half through the utilization of a half-cycle modulated waveshape memory. This permits controlling of a harmonic level with single modulation period data by modulating harmonics with a period having a fixed relation thereto. The instrument is simple in structure and suitable for fabrication as an integrated circuit.

2. Description of the Prior Art

Heretofore, there has been employed for producing a multiple or non-harmonic tone a method of mixing multi-series musical sounds of slightly different periods. This method requires the same number of systems and tone sources however. It is also possible to adopt a method which employs an analog delay element constituted by a CCD (Charge Coupled Device) or BBD (Bucket Brigade Device). With this method, however, an increase in the SN ratio or the number of circuit elements used raises the cost of an electronic musical instrument as a whole and it is difficult to produce a desired clear tone.

SUMMARY OF THE INVENTION

It is therefore an object of the present invention to provide an electronic musical instrument which is capable of arbitrarily producing a multiple or non-harmonic tone and which is simple-structured and suitable for fabrication as an integrated circuit.

Briefly stated, the electronic musical instrument of the present invention is one that generates a musical sound by controlling a harmonic coefficient and using calculating means based on the discrete Fourier transfer. It is provided with means for generating, for a first harmonic or the wave, a period function indicated by predetermined period data and generating, for the other harmonics period functions of a period having a predetermined relation to the period of the fundamental wave. The instrument includes a modulated waveshape memory which is read out by the period function from the period function generating means and means for multiplying modulated waveshape data from the modulated waveshape memory by a harmonic coefficient.

DESCRIPTION OF THE PREFERRED EMBODIMENTS

Figure 1A:
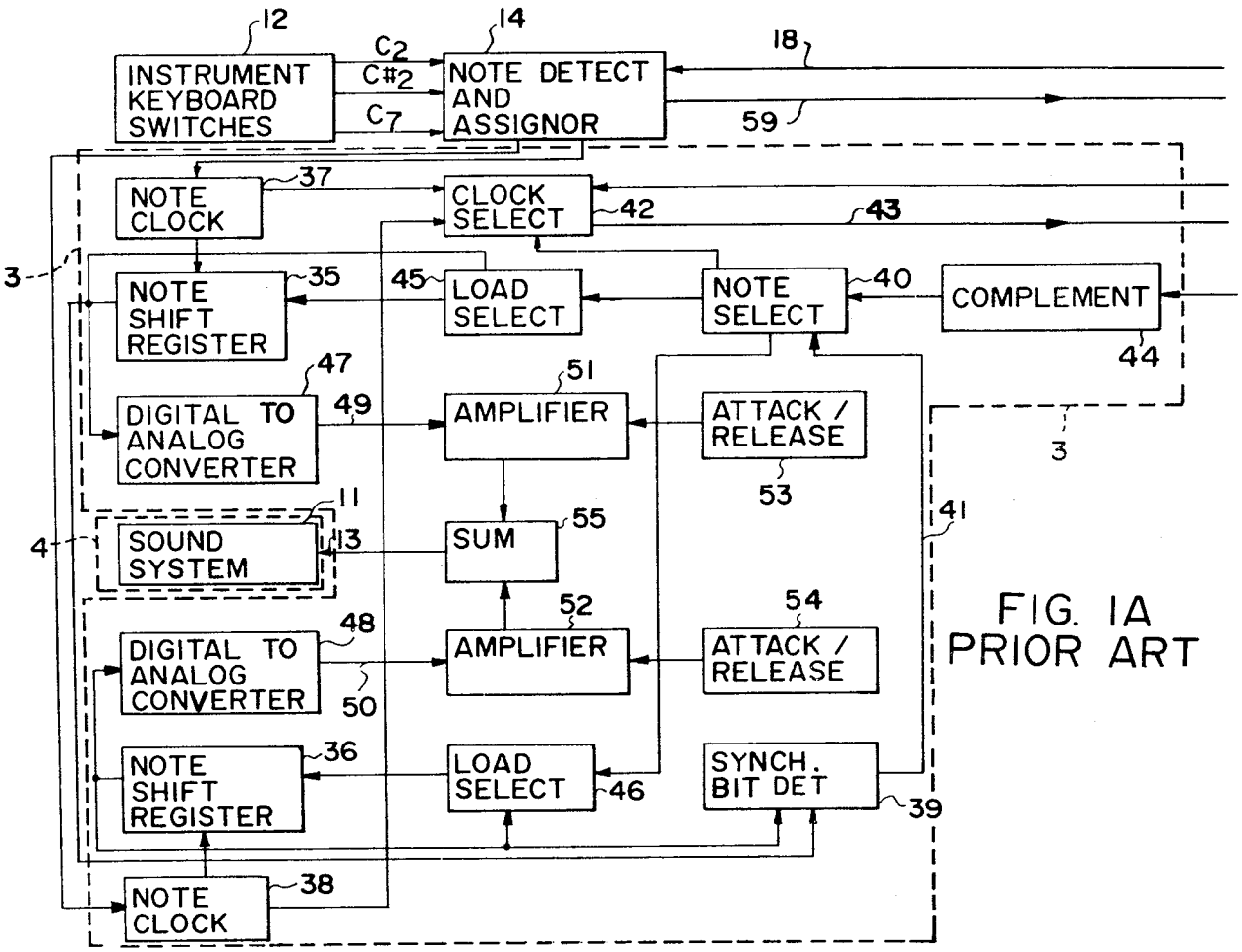
FIG. 1A PRIOR ART
FIGS. 1A and 1B are block diagrams showing the circuit arrangement of the aforementioned U.S. patent.
Figure 1B:
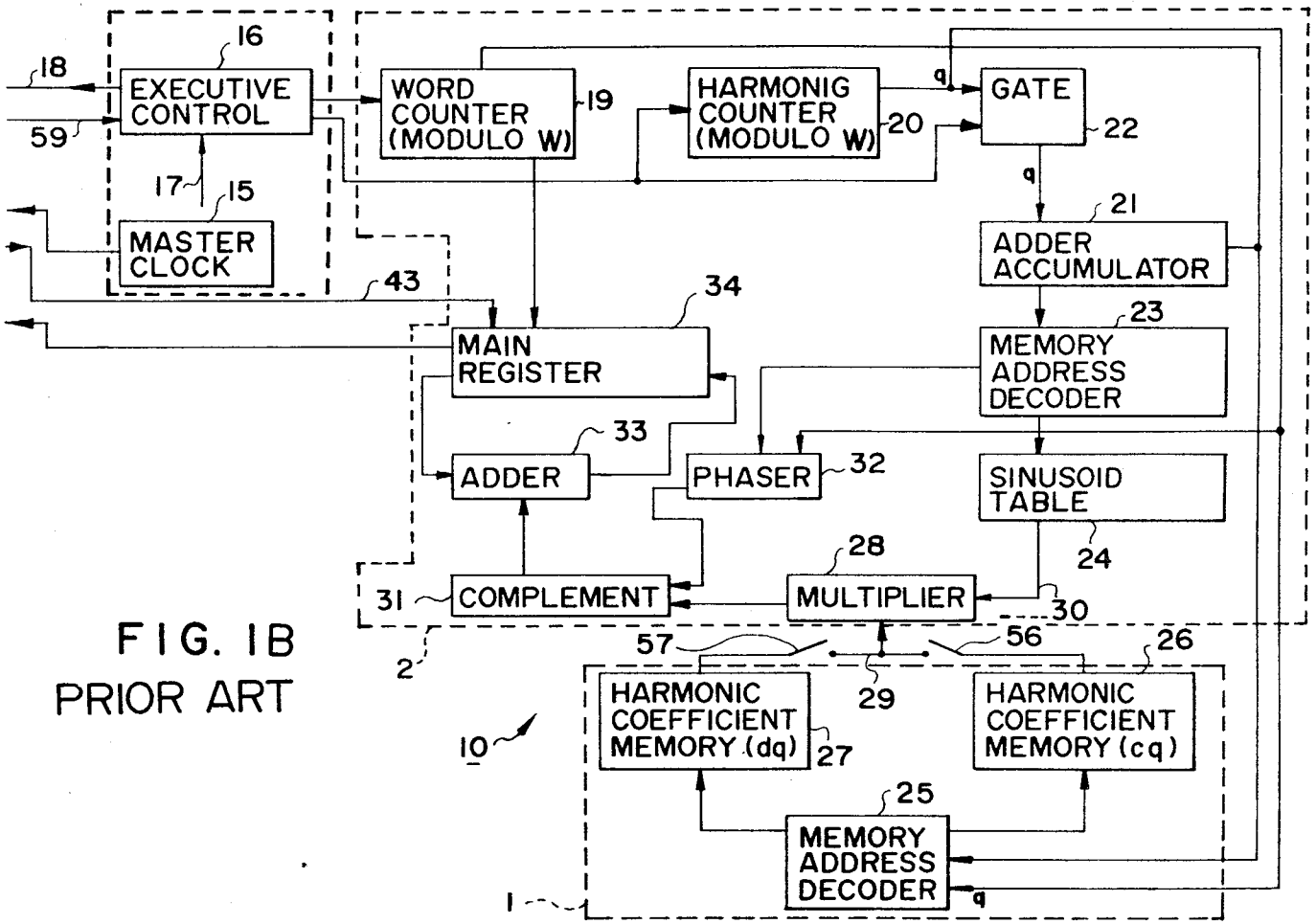
FIG. 1B PRIOR ART
Figure 1:
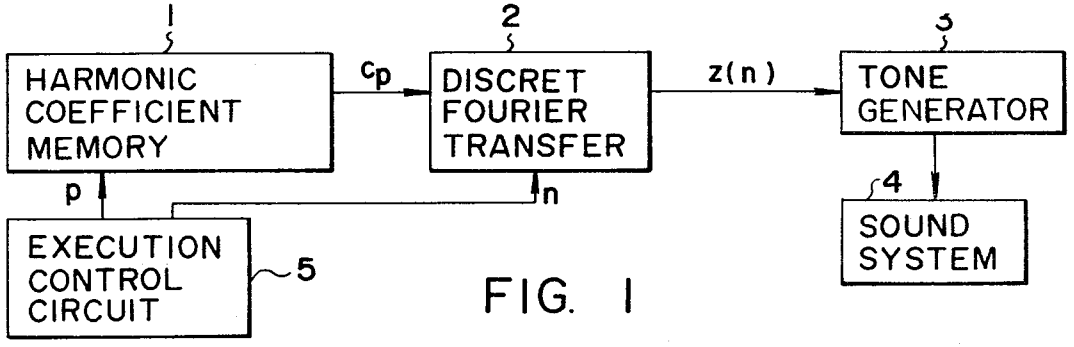
FIG. 1 is a block diagram showing a basic circuit arrangement of a discrete Fourier transfer system embodying the present invention.

FIG. 1 shows in block form the basic circuit arrangement of the discrete Fourier transfer system embodying the present invention.

In FIG. 1, the computation sequence of a discrete Fourier transfer 2 is controlled by an execution control circuit 5. In accordance with the computation sequence, a harmonic coefficient necessary for the computation by the discrete Fourier transfer is read out from a harmonic coefficient memory 1. Waveshape data computed by the discrete Fourier transfer 2 is transferred to a tone generator 3, from which it is read out by a desired note clock to form a digital musical waveshape. The musical waveshape thus obtained is applied to a sound system 4, wherein it is subjected to analog processing.

In the case where the discrete Fourier transfer 2 performs computations up to the 32nd harmonic, a sample value Z(n) for a sample point n (n=1, 2, . . . N) is given by $$Z(n) = \sum_{P=1}^{32} Cp \sin(2\ n/N)$$

where P is the harmonics degree and Cp is a harmonic coefficient.

The circuit arrangement shown in FIG. 1 is applicable to the invention of the aforesaid U.S. patent.

FIGS. 1A and 1B show the block diagram of FIG. 1 of the U.S. patent. In FIGS. 1A and 1B the block diagram of FIG. 1 is shown by the broken lines with the same reference numerals as in FIG. 1. The harmonic coefficient memory 1 corresponds to blocks 25, 26 and 27 in FIGS. 1B. The discrete Fourier transfer 2 corresponds to blocks 19, 20, 21, 22, 23, 24, 28, 31, 32, 33 and 34 in FIG. 1B. The tone generator 3 corresponds to blocks 35, 36, 37, 38, 39, 40, 42, 44, 45, 46, 47, 48, 51, 52, 53, 54 and 55 in FIG. 1A. The sound system 4 corresponds to a block 11 in FIG. 1A, and the execution control circuit 5 corresponds to blocks 15 and 16 in FIG. 1B. An instrument keyboard 12 and a note detect and assignor 14 are not included in this system but they can easily be incorporated therein.

In FIG. 1, the devices in FIGS. 1A and 1B are shown by functional blocks for the sake of brevity.

Figure 2:
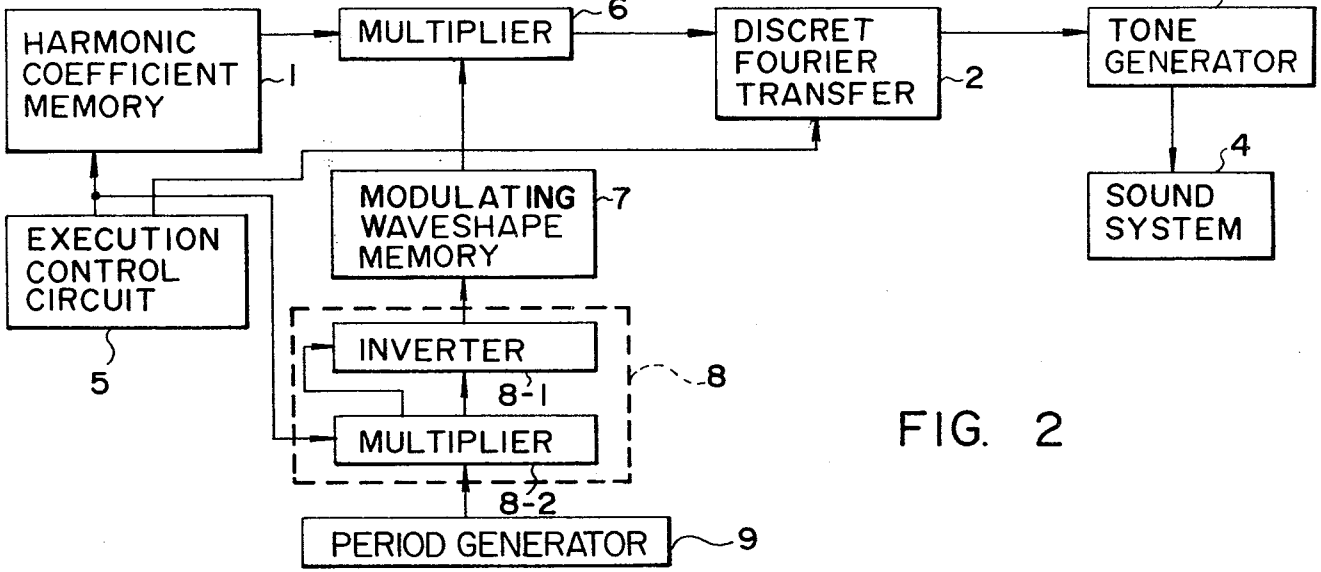
FIGS. 2 to 4 are block diagrams illustrating embodiments of the present invention.

FIG. 2 illustrates the arrangement of an embodiment of the present invention. In this embodiment, a multiplier 6 is provided betwen the harmonic coefficient memory 1 and the discrete Fourier transfer 2 for controlling an arbitrary harmonic level and, to perform this, data stored in a modulated waveshape memory 7 is read out therefrom by a period function which is provided from an address control circuit 8.

A period generator 9 counts on predetermined clock pulses to provide a binary code. The period generator 9 may also be of the type for receiving and accumulating binary codes. The output from the period generator 9 is applied to a multiplier 8-2, wherein it is multiplied by the harmonics degree P from the execution control circuit 5, thereby generating a period which is P times that of the fundamental wave. The multiplier 8-2 may also be replaced with an accumulator to which the harmonics degree is applied in the form of clock pulses. In this case, it is desirable that the computations by the discrete Fourier transfer 2 be performed in the sequence the fundamental wave-1st harmonic-2nd harmonic- . . . 32nd harmonic.

The output from the multiplier 8-2 is supplied to an inverter 8-1, which is inverted by the most significant bit of the output from the multiplier 8-2. The inverter output address the modulated waveshape memory 7. The memory 7 has stored therein the half cycle of a modulated waveshape. For example, $$M(x)=\tfrac{1}{2}[1+\cos\{2\pi(x-0.5)/N\}]$$

The number of sample points in one cycle is reduced by half by x=1, 2, . . . n/2 and the half cycle of a function represented by $F(x)=F(2\pi-x)$. It is a known technique to displace each sample point from the point of reversal by 0.5 for effectively reducing the number of sample points by half as described above.

The output from the modulated waveshape memory 7 is provided to the multiplier 6, wherein it is multiplied by the harmonics degree Cp read out from the harmonic coefficient memory 1. As a result of this, a modulated harmonic coefficient is applied to the discrete Fourier transfer. Thereafter, the same operations as described previously in connection with FIG. 1 are carried out.

Figure 3:
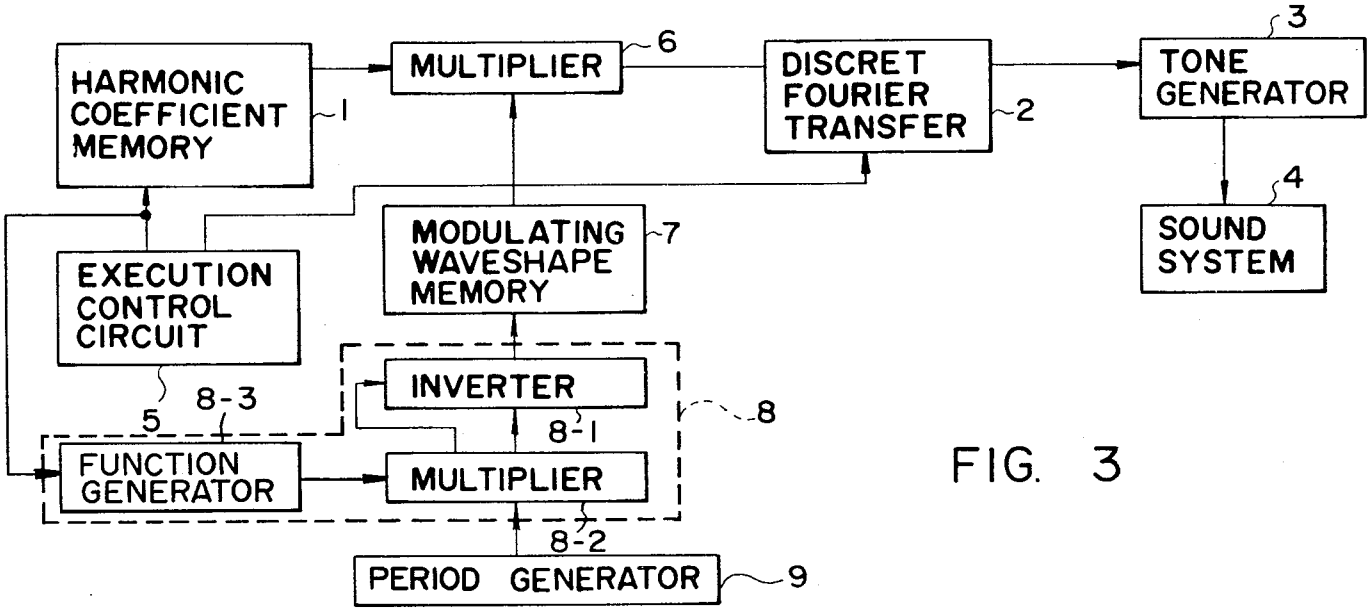

FIG. 3 illustrates the arrangement of another embodiment of the present invention. In FIG. 2 the period of harmonics is set to be P times that of the fundamental wave hut, in FIG. 3, the harmonics degree P from the execution control circuit 5 is fed to a function generator 8-3, wherein it is converted into a predetermined function, for instance, $Y=P_2$, which is applied to the multiplier 8-2. With this method, a non-harmonic tone can be obtained.

Figure 4:
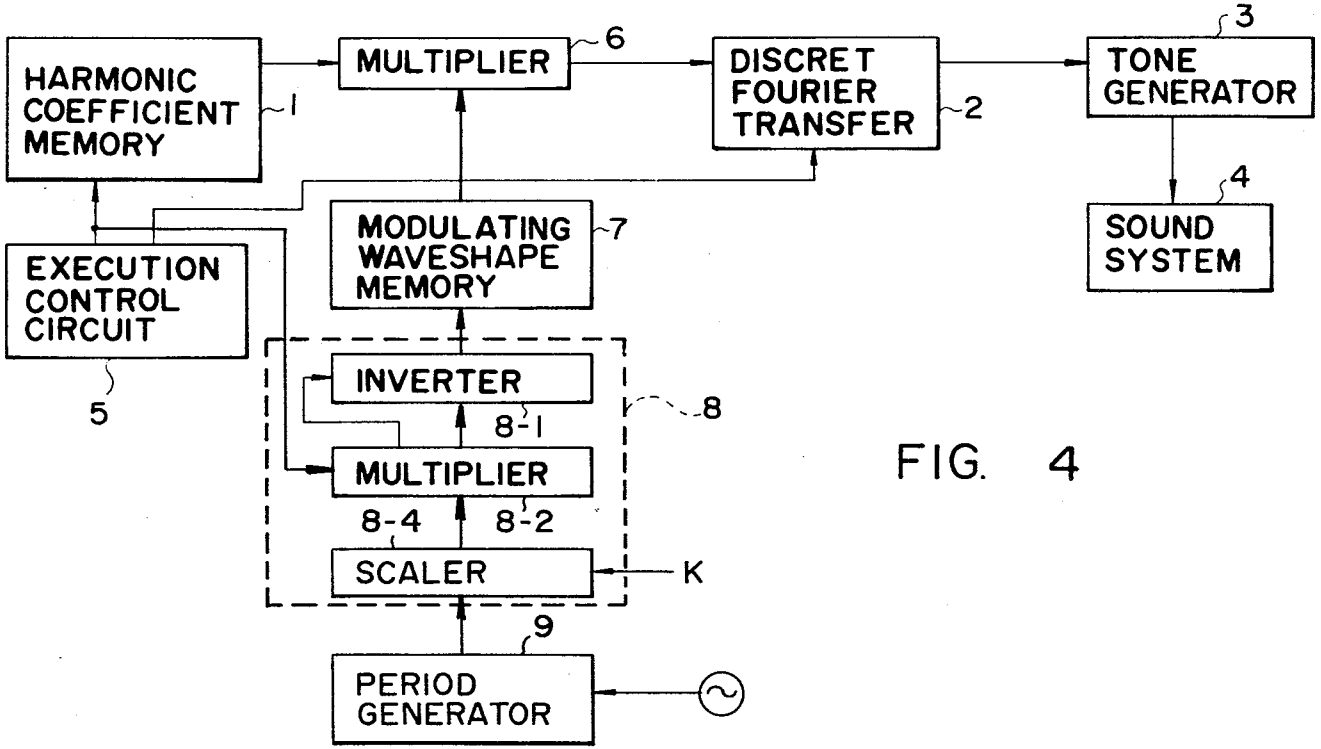

FIG. 4 illustrates the arrangement of still another embodiment of the present invention. In FIG. 4, the binary code from the period generator 9 is subjected to scaling with a constant K by a scaler 8-4 (formed by, for example, a multiplier or shifter), whereby a desired modulation rate is controlled. For example, by employing an envelope signal of a musical sound as the constant K, corresponding modulation can be effected. In this way, various modulations are made possible. It is also possible to combine the arrangements of FIGS. 3 and 4.

As has been described in the foregoing, according to the present invention, in an electronic musical instrument which generates a musical sound by controlling a harmonic coefficient and using computing means based on the discrete Fourier transfer, a modulated waveshape of half cycle is stored in modulated waveshape memory; the modulated waveshape is read out with a predetermined period in the case of a fundamental wave but, in the case of a harmonic wave, it is read out with a period having a predetermined relation to the period of the fundamental wave; and the modulated data thus read out is multiplied by the harmonic coefficient. By reading out the stored content of a half cycle from the modulated waveshape memory while displacing sample points by 0.5 as described previously, the memory capacity can be reduced by half permitting easy fabrication of electronic musical instrument as an integrated circuit. Moreover, by controlling harmonic coefficients corresponding to a multiple tone and a non-harmonic tone, their musical sounds can easily be produced.

It will be apparent that many modifications and variations may be effected without departing from the scope of the novel concepts of this invention.

What is claimed is:

1. An electronic musical instrument for producing a musical sound by controlling harmonic coefficients of harmonics in the sound and using, computing means based on dicrete Fourier transfer, comprising:

a harmonic coefficient memory for storing a set of harmonic coefficients each specifying the relative amplitude of a respective one of a set of sinusoidal harmonic components of the sound;

discrete Fourier transfer means for computing musical waveshape data by multiplying harmonic coefficients read out from said harmonic coefficient memory and a sinusoid value related to the degree of each of the harmonic efficients;

means for generating, for a first harmonic forming a fundamental wave for the sound and having a period, a period function indicated by the predetermined period data and for generating, for further harmonics of the sound, period functions of a period which is directly proportional to the period of the fundamental wave;

a modulating waveshape memory read out by the period functions from said means for generating;

means for multiplying modulating data from the modulating waveshape memory by said harmonic coefficients and for providing the multiplied data an an input to said discrete Fourier transfer means;

a plurality of tone generators supplied with the musical waveshape data from said discrete Fourier transfer means, for generating a digital musical waveshape by reading out the musical waveshape data by a desired note clock; and acoustic means for converting the digitial musical waveshape from said plurality of tone generators into an analog musical waveshape for producing a musical tone.

2. An electronic musical instrument according to claim 1, wherein the modulating waveshape memory has stored therein a half cycle of modulating data of the period functions expressed by $F(x)=F(2\pi-x)$, where x is 1, 2, . . . N/2 and N is a number of sample points of one cycle.

3. An electronic musical instrument according to claim 2, wherein the period function generating means is provided with means for generating a triangular wave by inverting a low order bit of each period function with a most significant bit of each period function and reads out the modulating waveshape memory.

* * * * *